US005119975A

United States Patent [19]

Jemielita

[11] Patent Number: 5,119,975

[45] Date of Patent: Jun. 9, 1992

[54] DROP VOLUME DISPENSING CLOSURE

[75] Inventor: Dariusz Jemielita, Montreal, Canada

[73] Assignee: Eldar Plastics Ltd., Montreal, Canada

[21] Appl. No.: 566,757

[22] Filed: Aug. 14, 1990

[51] Int. Cl.[5] ..... B65D 47/18

[52] U.S. Cl. ..... 222/420; 222/479

[58] Field of Search ..... 222/420, 479, 48.15

[56] References Cited

U.S. PATENT DOCUMENTS

| | | | |
|---|---|---|---|
| 2,173,662 | 9/1939 | Plattring et al. | 222/420 |
| 2,188,802 | 1/1940 | Beckett | 222/420 |
| 2,783,923 | 3/1957 | Croce | 222/420 |
| 3,117,701 | 1/1964 | Stull | 222/479 X |
| 4,880,146 | 11/1989 | Hudgins | 222/420 X |

FOREIGN PATENT DOCUMENTS

| | | | |
|---|---|---|---|
| 3816111 | 6/1989 | Fed. Rep. of Germany | 222/481.5 |
| 1480473 | 5/1967 | France | 222/479 |

*Primary Examiner*—Michael S. Huppert
*Assistant Examiner*—Gregory L. Huson

[57] ABSTRACT

A droplet dispensing closure for connection to a bottle opening. The dispensing closure comprises a cup-shaped body having outer circumferential holding ring and seals for retention and sealing engagement with the opening. A drop dispensing tube extends from a bottom wall of the body and has an outlet disposed above an outer rim of the cup-shaped body. A dispensing hole is provided in registry with the tube for admitting liquid into the tube. An air vent tube, of predetermined length, extends under the bottom wall to one side of the dispensing hole. The air vent tube has a constant diameter passage to admit outside air into the air vent tube. The dispensing tube has a constant inner diameter dispensing section. The air vent tube admits air into the bottle at an equal volume as liquid is forced through the dispensing hole when the bottle is inverted at a position past horizontal. The drip rate is slow enough to permit the counting of drops being dispensed.

5 Claims, 2 Drawing Sheets

DROP VOLUME DISPENSING CLOSURE

BACKGROUND OF INVENTION

1. Field of the Invention

The present invention relates to an improved droplet dispensing closure which is connectable to a bottle neck opening and preferably, but not exclusively, a bottle containing a medicinal liquid. The droplet closure has a dispensing tube in which at least a dispensing section thereof is of constant inner diameter and wherein droplets can be dispensed, as soon as the bottle is inclined above the horizontal, at a rate which is slow enough to permit the counting of individual drops emitting from the dispensing tube.

2. Description of Prior Art

Various closure members are known for dispensing liquid from a bottle at a drip feedrate. A product similar to that of the present invention is described, for example, in German Patent DE 29 49 223 dated Sept. 19, 1980. The present invention is an improvement of such closure and wherein drops can be dispensed as soon as the bottle is positioned at an angle above horizontal, whereas in the reference, it is necessary to place the bottle to a vertical position in order for the closure to start dispensing. The inner diameter of the drip tube is often tapered and the drops are not of even size and air can infiltrate through the drip tube.

Another disadvantage of the prior art closures is that when the sealing cover is placed onto the closure, it often damages the dispensing tube or the air vent tube, thereby affecting the operation of the dispensing closure. Also, the cover often touches the end of the dispensing tube and forces liquid back into the bottle. This could result in contamination as the liquid forced back in was exposed to outside air and light. Still further, the prior art designs often admit too much air into the bottle at an uneven rate, thereby resulting in an uneven dispensation rate.

It is desirable that the dispensing rate be slow and constant whereby the drops can be easily counted as they are dispensed. This is particularly important when dispensing a medical product. It has also been found that it is important to maintain, at least the dispensing section of the dispenser tube of a constant diameter, in order to achieve an accurate drop size in dispensing the fluid.

SUMMARY OF INVENTION

It is a feature of the present invention to provide an improved droplet dispensing closure for connection to a bottle opening for dispensing liquid therefrom at an even drop volume and slow enough to permit the counting of individual droplets being dispensed, and wherein such liquid can be dispensed by inverting the bottle past the horizontal.

Another feature of the present invention is to provide an improved droplet dispensing closure for connection to a bottle opening and wherein the dispensing closure is attachable in a cover which is securable over a bottle neck opening to simultaneously attach the dispensing closure in the bottle opening.

According to the above features, from a broad aspect, the present invention provides a droplet dispensing closure for connection to a bottle opening. The dispensing closure comprises a cup-shaped body having outer circumferential retention means and sealing means for retention and sealing engagement with the opening. A drop dispensing tube extends from a bottom wall of the body and has an outlet opening disposed above an outer rim of the cup-shaped body. A dispensing hole is provided in registry with the tube for admitting liquid into the tube. An air vent tube, of predetermined length, extends under the bottom wall to one side of the dispensing hole. The air vent tube has a constant diameter passage to admit outside air into the air vent tube. The dispensing tube has a constant inner diameter dispensing section. The air vent tube admits air into the bottle at an equal volume as liquid is forced through the dispensing hole when the bottle is inverted at a position past horizontal. The drip at the outlet of the dispensing tube is slow enough to permit counting of drops being dispensed.

BRIEF DESCRIPTION OF DRAWINGS

A preferred embodiment of the present invention will now be described with reference to the examples thereof as illustrated in the accompanying drawings in which.

DESCRIPTION OF PREFERRED EMBODIMENTS

Figure 1:
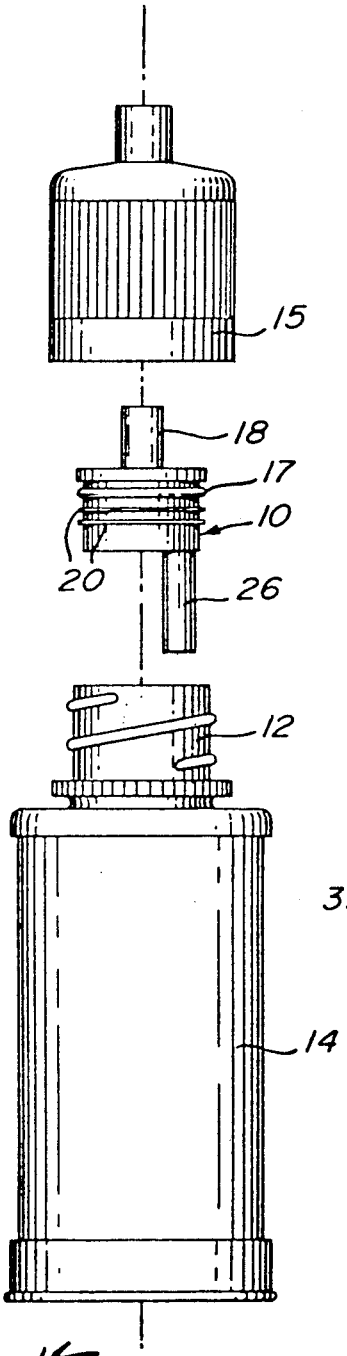
FIG. 1 is an exploded view showing the droplet dispensing closure of the present invention in relation to a bottle containing a liquid therein and also in relation with a cover.
Figure 2:
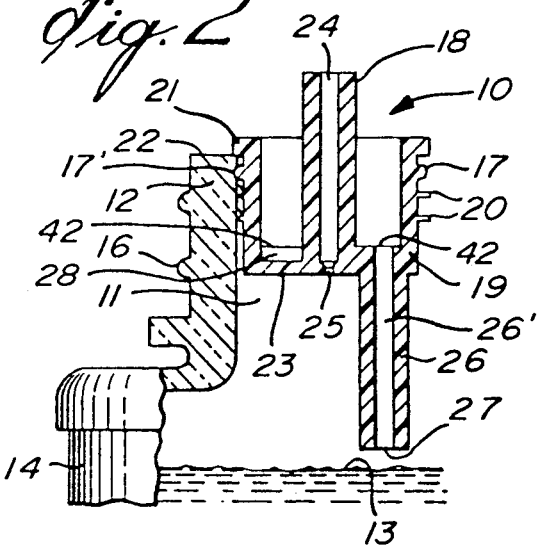
FIG. 2 is an enlarged fragmented section view showing the droplet dispensing closure construction and its relationship with a bottle neck opening.

Referring now to the drawings, and more particularly to FIGS. 1 and 2, there is shown at 10, the droplet dispensing closure of the present invention. As herein shown, the dispensing closure is connectable in the opening 11 of a bottle neck 12 so as to dispense the liquid 13 contained in the bottle, in droplet form. The bottle 14 can be of any shape or size and is preferably, a bottle containing a medicinal liquid 13 therein. A sealing cover 15 is placed in threaded engagement about the bottle neck 12 by engaging the threads 16 thereon and seals an air passage in the air vent tube 26 and isolates the dispensing tube 18 formed with the dispensing closure to prevent dispensing or expose the liquid to contaminants.

As better illustrated in FIG. 2, the dispensing closure 10 is molded from plastic material, herein polyethylene, and defines an outer cylindrical wall having a circumferential holding ring 17 and one or more cylindrical sealing flanges 20 thereabout to constitute a sealing means when the body 19 is pressfitted into the bottle neck opening 11. The bottle neck also has a circumferential channel 17' therein for receiving the ring 17 in snap-fit therein. The flanges 20 deform in the bottle neck opening 11 to constitute a plurality of further spaced apart seals all around the bottle neck opening to prevent the liquid 13 from seeping out of the bottle. A cylindrical abutment rim 21 is also provided about the cup-shaped body 19 and sits on the outer ledge 22 of the bottle neck 12.

The droplet dispensing closure 10 is injection molded as a single part with the drop dispensing tube 18 being disposed centrally of the cup-shaped body 19 and extending from a bottom wall 23 of the cup-shaped body. The dispensing tube defines an outlet opening 24 at its free end which is located at a predetermined distance above the abutment rim 21 of the cup-shaped body 19. This permits the tube 18 to be directed closer to the ear, nose, etc. of a patient for dispensing droplets. A dispensing hole 25 is provided in the bottom wall and in registry with the dispensing tube 18 for admitting liquid into the tube.

An air vent tube 26 is also molded integrally with the cup and extends downwardly from the bottom wall 23. The air vent tube 26 has a straight body which extends a predetermined distance under the bottom wall 23 to a free end 27 which is disposed above the liquid level 13 contained in the bottle. An air admission hole 26' of constant diameter is provided in the air vent tube to admit outside air into the air vent tube and the bottle, when inverted. The size of the air admission hole 26' and the dispensing hole 25 are predetermined and have a fixed ratio dependent on the viscosity of fluid to be dispensed. Based on the relative viscosity of liquids, the ratios of openings of the feed tube to the air intake tube are:

| | |
|---|---|
| Oil substances | 1.666 |
| Water | 0.625 |
| Alcohol mixtures | 0.375 |
| Alcohol | 0.2876 |

Figure 4:
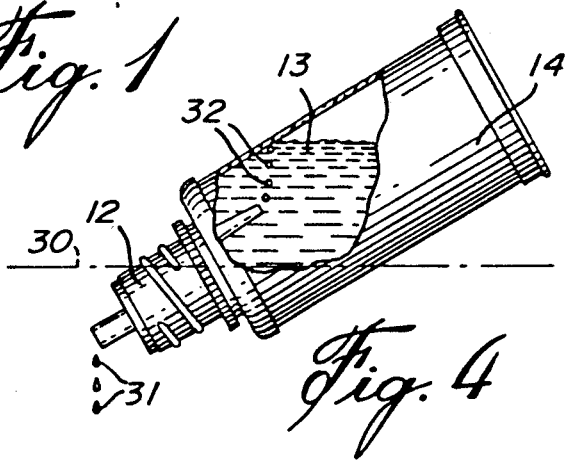
FIG. 4 is a side view illustrating the operation of the droplet dispensing closure when connected to a bottle containing a medicinal liquid therein.

This ratio achieves a constant drip volume when dispensing liquid from the bottle through the dispensing tube. It is pointed out that with the design of the present invention, as soon as the bottle 14 is tipped past the horizontal line 30, as shown in FIG. 4, the droplet dispensing closure 10 will start dispensing drops of even size, as shown at 31, and of a constant volume. Simultaneously, the air vent will admit air bubbles 32 into the liquid 13 at an equal volume. In order for this to be achieved, it is also important that the inner diameter 24' of the tube 18 be of a constant size to prevent air from seeping into the tube as liquid is dispensed. A plurality of division walls 28 form pockets about the inner circumferential top wall 42 of the dispensing closure 10 to retain any fluid that may drip along the dispensing tube 18. This fluid is minimal and would not form droplets when the bottle is inverted. The dispensing tube intake end extends flush with the top edge of these division walls so as to receive thereon the sealing end 38 of a sealing annular ring provided in the cover 15 to seal the air vent hole 26'. The division walls 28 also constitute strengthening ribs for the cover.

Figure 3:
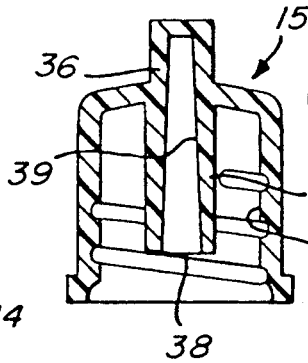
FIG. 3 is a section view showing the cover design.

Referring now additionally to FIG. 3, there is shown the construction of the cover 15 which is removably securable about the bottle neck 12. The cover 15 is provided with an inner cylindrical thread 35 for engagement with the outer thread 16 of the bottle neck. A locating annular sealing ring 37 also extends axially and centrally from the inner top wall of the cover. The inner surface 36 of the ring 37 is tapered to facilitate locating the dispensing tube 18 therein and to frictionally engage the tube 18. Accordingly, for automatic assembly, the dispensing closure 10 is frictionally retained in the cover 15 by frictional retention of the dispensing tube 18 within the ring 37. The combination is then disposed over the bottle neck and the closure 10 is pushed in the bottle opening. The holding ring 17 enters the channel 17' and the cap is released or rotated about the bottle neck. Accordingly, the entire assembly is connected to the bottle in one machine step. The cover 15 is also provided with a protrusion section 36 so as to form an elongate cavity 39' with the ring 37. The cavity 39 has a taper and is larger at its inner open end to facilitate locating the dispensing tube 18 therein. When the cover 15 is threaded about the bottle neck, the bottom end 38 of the sealing ring 37 will sit on the top surface 42 of the ribs 28 and of the air vent tube 26. Accordingly, air cannot be admitted in the bottle and no liquid will be dispensed through the tube 18 when the bottle is inverted. The dispensing tube 18 is also sealed by the tapered cavity 39 in the cover 15.

Figure 5:
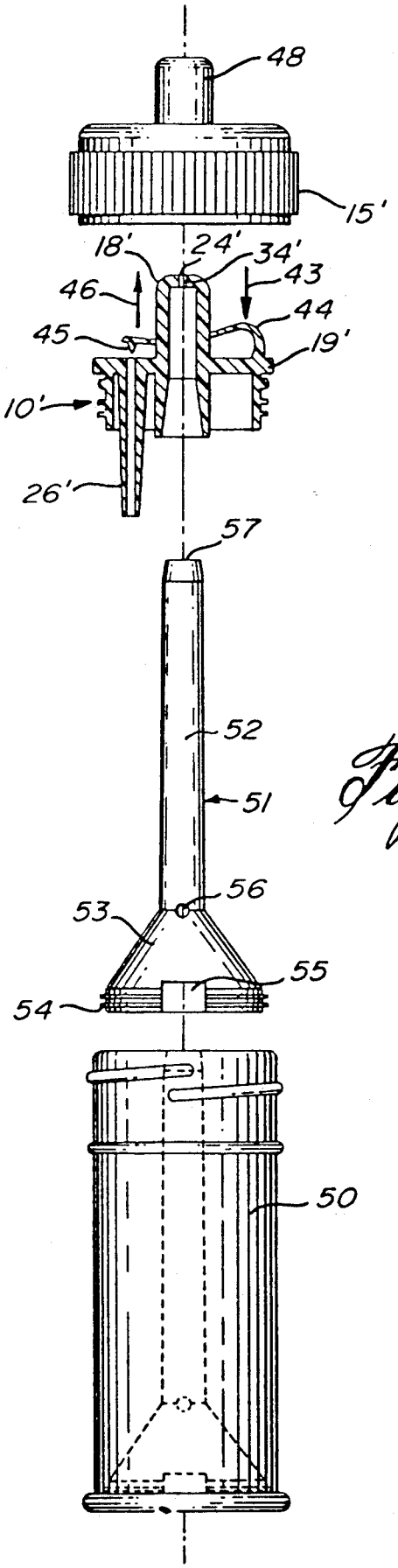
FIG. 5 is an exploded view of an improved dispensing closure and bottle for dispensing accurate single doses of a medicinal liquid.

Referring now to FIG. 5, there is shown a further embodiment of the droplet dispensing closure 10' of the present invention as herein used with a single dose dispensing bottle 50. In this embodiment, the dispensing section 34' of the closure 10' is provided at the end of the dispensing tube 18'. The cover 15' is of different shape and is provided with a convex nipple 48 therein to abut against the dispensing opening 24'. As herein shown, the air vent is provided as a constant diameter vent tube and this droplet dispensing closure was conceived to dispense drops at a much faster rate than the closure illustrated in FIGS. 1 and 2. A plunger element, in the form of a tapered nib 45, is insertable into the outer end of the vent tube 26' to seal the tube. This plunger element is connected to a flexible strap 44 which is molded integral with the body 19'. By applying downward pressure on the connected end of the strap 44, as shown by arrow 43, the tapered nib 45 will be subjected to an outer pulling force, as indicated by arrow 46 to dislodge the nib 45 from the opening of the vent hole to cause the dosage in the bottle 50 to flow out when the bottle is inverted. In this particular embodiment, the inner diameter of the vent tube and the dispensing section of the dispensing tube are identical. Accordingly, drops are dispensed at an even flow rate when the bottle is inverted to any position past the horizontal, as shown in FIG. 4.

A dosage calibrating funnel element 51 is removably positioned inside the bottle 50 to automatically calibrate a predetermined quantity of liquid to be dispensed through the dispensing tube 18'. The funnel element 51 is comprised of an elongate, open-ended, tubular portion 52 having a conical seating section 53. Retention friction ribs 54 are provided about a base wall of the seating section to hold the funnel element 51 firmly within the bottle 50. An opening 55 admits liquid within the seating section 53 and tubular portion 52 when the bottle is not inverted. An excess flow hole 56 is provided for excess liquid to leak out of the funnel element 51 when the bottle is inverted. Accordingly, the precise liquid dose is determined by the size of the tubular portion from its free end 57 to the hole 56. One or more of these holes can be positioned about the tubular portion 52 at a predetermined location therealong depending on the volume of the desired dosage. The free end 57 of the tubular portion 52 is received in friction fit within the flared bottom open end 58 of the dispensing tube 18' so as to permit only the liquid within the tube 52 to be dispensed.

It is within the ambit of the present invention to cover any obvious modifications of the preferred examples described herein, provided such modifications fall within the scope of the appended claims.

I claim:

1. A droplet dispensing closure for dispensing medicinal liquids and connectable to a bottle opening, said dispensing closure comprising a cup-shaped body having outer circumferential retention means and sealing means for retention and sealing engagement with said opening, a drop dispensing tube extending from a bottom wall of said body and having an outlet opening disposed above an outer rim of said cup-shaped body, a dispensing hole in registry with said tube for admitting liquid into said tube, an air vent tube of predetermined length extending under said bottom wall to one side of said dispensing hole, said air vent tube having a constant diameter passage to admit outside air into said air vent tube, said dispensing tube having a constant inner diameter dispensing section, said air vent tube admitting air into said bottle at an equal volume as liquid is forced through said dispensing hole when said bottle is inverted at a position past horizontal, said drip rate being slow enough to permit the counting of drops being dispensed, said drop dispensing tube being disposed in the central axis of said closure, there being a plurality of pockets formed about said dispensing tube by a plurality of division walls, and said air vent tube terminating flush with said division walls.

2. A droplet dispensing closure as claimed in claim 1 wherein said cup-shaped body is a body molded from plastic material and defines an outer cylindrical wall having a retention ring constituting said retention means and one or more cylindrical sealing flanges thereabout and constituting said sealing means when said body is press-fitted into a bottle neck opening with said retention ring snap-fitted into a retention channel in said opening.

3. A droplet dispensing closure as claimed in claim 1 wherein the inner diameter of said dispensing tube and said air vent tube are different and have a fixed ratio dependent on the viscosity of the liquids to be dispensed.

4. A droplet dispensing closure as claimed in claim 1 wherein said dispensing hole is provided in said bottom wall of said closure and aligned with said dispensing tube.

5. A droplet dispensing closure for dispensing medicinal liquids and connectable to a bottle opening, said dispensing closure comprising a cup-shaped body having outer circumferential retention means and sealing means for retention and sealing engagement with said opening, a drop dispensing tube extending from a bottom wall of said body and having an outlet opening disposed above an outer rim of said cup-shaped body, a dispensing hole in registry with said tube for admitting liquid into said tube, an air vent tube of predetermined length extending under said bottom wall to one side of said dispensing hole, said air vent tube having a constant diameter passage to admit outside air into said air vent tube, said dispensing tube having a constant inner diameter dispensing section, said air vent tube admitting air into said bottle at an equal volume as liquid is forced through said dispensing hole when said bottle is inverted at a position past horizontal, said drip rate being slow enough to permit the counting of drops being dispensed, a cover removably securable about a bottle neck having said bottle opening, said cover having an inner sealing ring for sealing engagement with a top opening of said air vent tube, said sealing ring having a tapered elongated cavity therein extending along the central axis of said closure, said dispensing tube extending into said cavity and in sealing engagement with said tapered wall with the top of said dispensing tube being spaced from the base of said cavity with said dispensing tube in friction retention fit within said cavity so that said dispensing closure may be supported by said cover.

* * * * *